US006622892B2

(12) United States Patent
Vance

(10) Patent No.: US 6,622,892 B2
(45) Date of Patent: Sep. 23, 2003

(54) SLEEVE AND DISPENSER FOR BRICK-TYPE PACKAGE

(75) Inventor: Blair Vance, Gurnee, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 10/058,464

(22) Filed: Jan. 28, 2002

(65) Prior Publication Data

US 2003/0141317 A1 Jul. 31, 2003

(51) Int. Cl.[7] ..... B67D 5/60
(52) U.S. Cl. ..... 222/143; 222/183; 222/321.7
(58) Field of Search ..... 222/131, 183, 222/321.7, 321.9, 143

(56) References Cited

U.S. PATENT DOCUMENTS 3,854,633 A * 12/1974 Bouvaist ..... 222/183
4,974,744 A * 12/1990 Shanklin et al. ..... 220/278
6,412,663 B1 * 7/2002 Adamson, II et al. ..... 222/183

* cited by examiner

*Primary Examiner*—Joseph A. Kaufman
(74) *Attorney, Agent, or Firm*—Welsh & Katz, Ltd.

(57) ABSTRACT

A dispensing support is for use with an associated package having a parallelepiped shape. The support includes a sleeve having at least three contiguous walls including at least one side wall and a top wall. The side wall is configured to extend along the length of the one of the package side panels and the top wall has an opening therein configured to lie along the package top. The sleeve includes a locking element extending from one of the walls at a free end thereof to engage one of the package panels to secure the package within the sleeve. A dispenser extends through the top wall opening and is configured for insertion into the package. The package is fitted into and retained within the sleeve and the dispenser operates to dispense product from the package.

20 Claims, 3 Drawing Sheets

SLEEVE AND DISPENSER FOR BRICK-TYPE PACKAGE

BACKGROUND OF THE INVENTION

The present invention is directed to a sleeve or support for a brick-type package and a dispenser for the contents of the package. More particularly, the present invention pertains to an open sleeve or support and a pump-type dispenser use with brick-type packages.

Brick-type packages are well-known in the art. An exemplary widely-known and used package is the Tetra Brik® package commercially available from Tetra Brik Packaging Systems S.p.A. of Modena, Italy. These brick-type packages have four upstanding sidewalls, a flat top and a flat bottom. The flat top and bottom can be in the form of a rectangle or a square, for a desired application and package volume.

Many types of closures are known for these packages. For example, a plastic closure having a frangible edge region and a hinge is known, in which closure the closure portions within a central region of the frangible portion is lifted or raised to provide access to the container contents. In many such containers, a foil or other inner seal is provided with a tab that can be likewise pulled from the package to provide product access.

Many of the brick-type packages are used in food service establishments. As such, dispensing the product can be problematic. This is particularly true in those instances where it is not desirable to transfer the product from the package to a second dispensing container. Such product transfer and secondary containers are undesirable in that they provide a path for contamination, as well as additional equipment handling.

It is also less than desirable to merely leave the open package dispensing location. Again, this is less than optimally hygienic, and can result in contamination of the product. One known dispensing arrangement includes a six sided or cubic container having a dispenser or pump mounted to the top of the cube. While such an arrangement may serve to reduce the opportunity for contamination, such a container has been found to be difficult to properly clean and has been found to be quite costly in manufacture and use. As such, these containers have not found wide spread use.

Accordingly, there exists a need for a sleeve and dispenser for use with brick-type packages. Desirably, such a sleeve is cost-effective (inexpensive to produce) and easy to use. Most desirably, such a sleeve is readily cleaned, as by cleaned in a washing appliance. Most desirably, such a sleeve and dispenser is a one-piece assembly that can further be used for advertising and marketing purposes.

BRIEF SUMMARY OF THE INVENTION

A dispensing support provides structural support in a dispenser for use with an associated brick-type package. A typical brick package has a parallelepiped shape having a top panel having a length, a bottom panel having a length equal to the top panel length and two pairs of opposing side panels having a height. Each panel is contiguous with each of its adjacent panels.

The dispensing support includes a sleeve having at least three contiguous walls including at least one side wall and a top wall. The at least one side wall is configured to extend along the length of the one of the package side panels. The top wall has an opening therein configured to lie along the package top.

The sleeve includes a locking element extending from one of the walls at a free end thereof. The locking element is configured to engage one of the package panels to secure the package within the sleeve.

A dispenser extends through the top wall opening and is configured for insertion into the package. The package is fitted into and retained within the sleeve and the dispenser operates to dispense product from the package.

In a present embodiment, the three contiguous walls include a bottom wall, a side wall and a top wall. The top wall can extend fully along the length of the package top panel. Alternately, the top wall extends a length less than a length of the bottom wall, or less than the length of the package top panel.

In one configuration, an upwardly projecting spout extends from the top wall opening. The spout can include threads formed thereon to threadedly engage the dispenser. Alternately still, the opening can be flush with the top wall and a package having a spout affixed to the top panel can extend through the opening.

The side wall can include openings formed therein, such as a lattice-like configuration. This can be configured in conjunction with indicia or graphics on the package to permit the use of openings for product package markings and the like (e.g., marketing and advertising).

The sleeve can include a flange that extends between the top wall and the side wall, generally transverse to the top and side walls. The flange is configured to provide visual access to the side panel of the package in the sleeve. This provides a user to "see" the package contents (by markings) and, again, permits use to, for example, support product advertising and marketing.

The sleeve locking element can be formed on the bottom wall. In a present configuration, the locking element is formed at an end of the bottom wall. A lateral stop element can also be formed at the bottom wall to prevent lateral shifting of the package in the sleeve.

Optionally, the sleeve can include a latching element for securing the sleeve to a like, adjacent sleeve. In this manner, a plurality of packages, in sleeves, can be placed next to one another.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
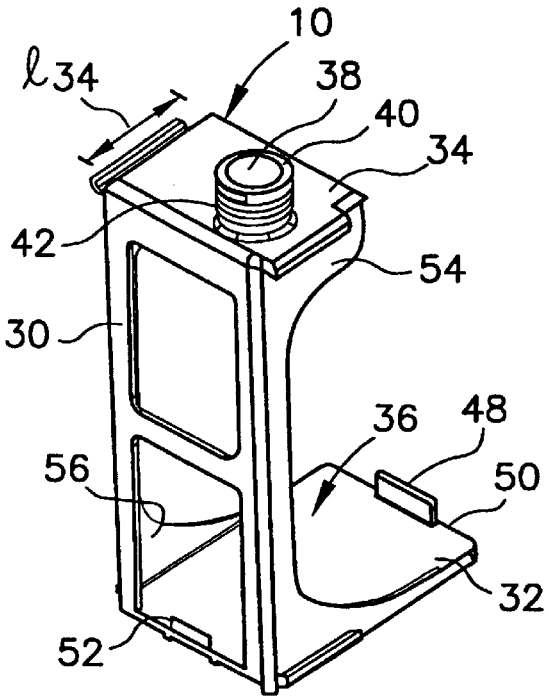
FIG. 1 is a perspective view of a sleeve for a brick-type package embodying the principles of the present invention, the sleeve being illustrated with a threaded spout at the top wall for receiving a dispenser.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Figure 2:
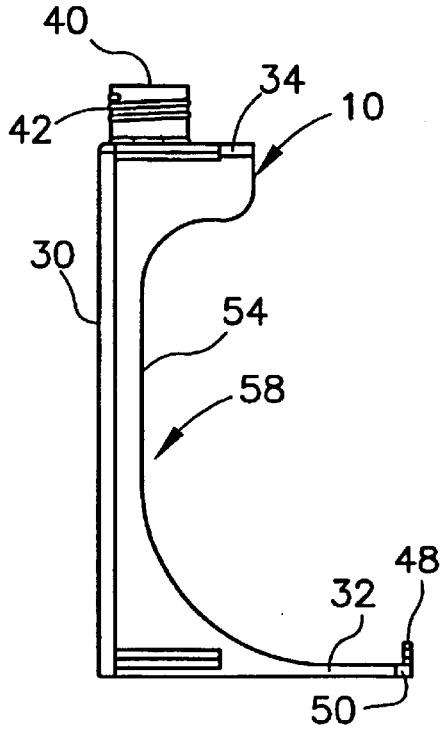
FIG. 2 is a side view of the sleeve of FIG. 1.
Figure 3:
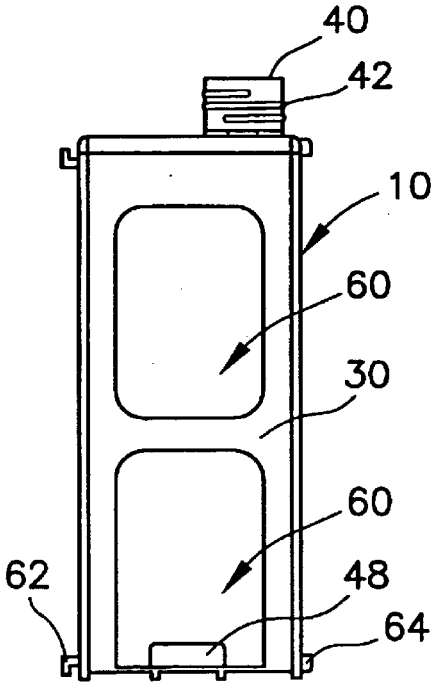
FIG. 3 is a rear view of the sleeve of FIG. 1.
Figure 11:
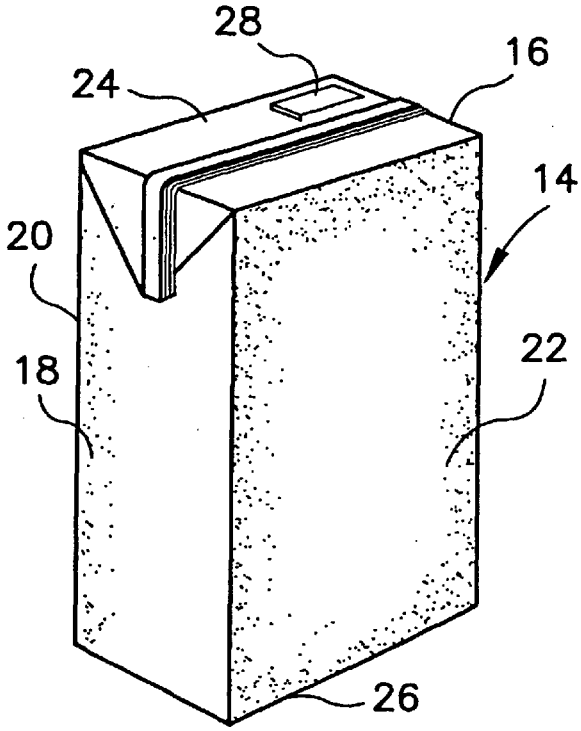
FIG. 11 is a perspective illustration of an exemplary brick-type package.

Referring now to the figures and in particular to FIGS. 1–3, there is shown a sleeve 10 configured to receive a dispenser 12 for use with an associated brick-type package 14. Referring briefly to FIG. 11, the brick-type package 14 is a well recognized parallelepiped package that can have a square or rectangular footprint. The package 14 has first and second pairs of opposing side walls 16, 18 and 20, 22, respectively, and top and bottom walls 24, 26, respectively the package 14 can be fitted with a pull tab type of seal 28 to provide access to the package 14 contents. For purposes of the present disclosure, the walls of the package are referred to as panels and the walls of the sleeve are referred to as walls to reduce any confusion that might otherwise result. An exemplary package is disclosed and described in Rausing, et al., U.S. Pat. No. 3,347,444, commonly assigned with the present application, and incorporated herein by reference.

In many uses, the package 14 contains food product that is intended for use in a commercial food-service establishment or setting. In such an environment, in past practice, product may be transferred from a package to a secondary or supplemental serving or dispensing container. The transfer of contents increases the opportunity for contamination of the product and increases the quantity of serving or dispensing containers that may require washing or sterilization. It can also increase the amount of waste produced that must ultimately be disposed of.

The present sleeve 10 and dispenser 12 alleviates many of these commonly recognized problems. The sleeve 10 is a generally C-shaped support for the package 14. As will be recognized by those skilled in the art, although the package 14 is somewhat rigid, it is typically made of a laminate having a paperboard core. As such, pressure on the package 14 can result in compressed or crushed panels. The present sleeve 10 provides structural support for the package 14, thus reducing the potential for compressing or crushing the panels of the package 14.

In a current embodiment, the sleeve 10 includes an upstanding side wall 30, a bottom wall 32 and a top wall 34. The sleeve 10 is configured such that the package 14 fits snuggly within the interior region indicated at 36 of the sleeve 10 "C". The bottom and top walls 32, 34 can be "full" walls in that they extend over the entire length l and width w of their respective package panels, or as illustrated in FIGS. 1–4, the top wall 34 can be formed as a "partial" wall extending over a portion of the length l or width w of the top panel 24. That is, the top wall 34 has a length $l_{34}$ less than the length l of the package top panel 24. The side wall 30, of course, extends the entire height h of the package side panel 16.

Figure 8:
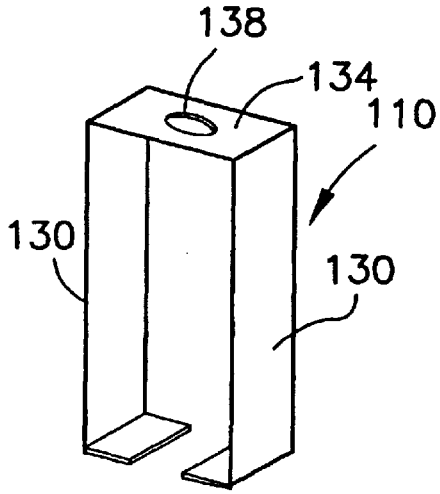
FIG. 8 is a perspective illustration of still another embodiment of the sleeve that is configured for fitting over opposing sidewalls of the package and includes an opening in the top wall for receipt of a spout from a package.
Figure 9:
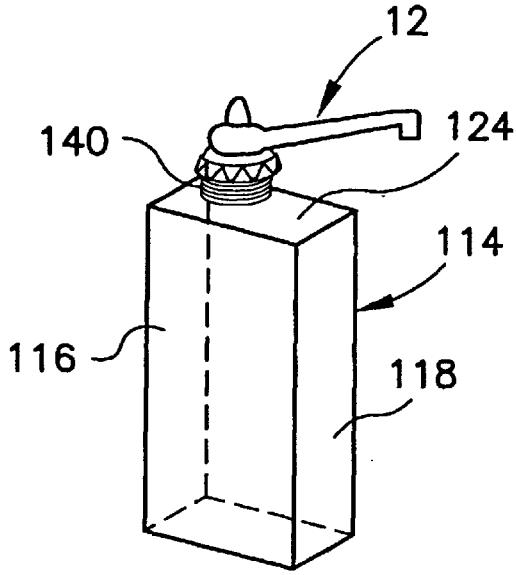
FIG. 9 is a perspective illustration of a package for use with the sleeve of FIG. 8 with a dispenser fitted thereto.

Referring briefly to FIG. 8, an alternate sleeve 110 can be configured to cover opposing side panels 116, 118 of the package 114 and the top panel 124, again resembling a "C" shape or an inverted "U" shape. In this embodiment, the top wall 134 extends the entire length l of the package top panel 124, and at least one of the sleeve side walls 130 extends the entire height h of the package side panel 116. This provides increased structural integrity to the sleeve 110 and package 114 when in combination.

Referring again to FIGS. 1–3, the top wall 34 includes an opening 38 that is configured to receive the dispenser 12. The exemplary opening 38 illustrated in FIGS. 1–3 is formed by an upwardly extending spout-like projection 40. The spout 40 includes threads 42 formed thereon for threadedly receiving a cap 44 on the dispenser 12, which cap 44 has threads complementary to the threads 42 of the dispenser 12. Other means for securing the dispenser 12 to the top wall 34 include, for example, bayonet-type (twist-type) locks, friction-fit locks and the like. All such securing means are within the scope and spirit of the present invention.

Figure 7:
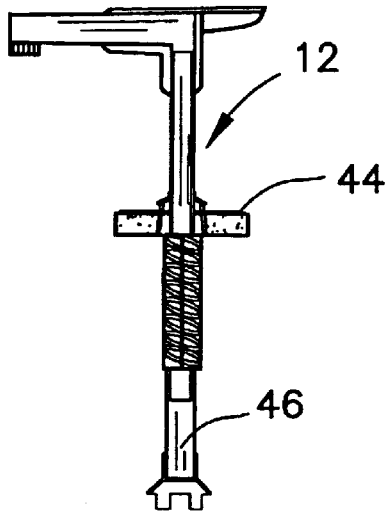
FIG. 7 is a cross-sectional view of an exemplary dispenser.

The dispenser 12, as seen in FIG. 7, can be of any type, such as an ENGLASS® MAXI dispenser, commercially available from RIEKE® Corporation of Auburn, Ind. A preferred dispenser 12 is a pump-action, suction dispenser having a suction pipe 46 that extends fully to the bottom of the package 14 when inserted therein.

In a present embodiment, the sleeve 10 includes a full bottom wall 32 on which the package 14 rests when the package 14 is in the sleeve 10. The bottom wall 32 can include an upwardly turned lip 48 at a free end 50 (that end 50 farthest from the side wall 30). The lip 48 provides a lock to maintain the package 14 securely within the sleeve 10, and to prevent inadvertent separation of the package 14 from the sleeve 10. Alternately, the lock 48 can be provided by a projection or hook-like element (not shown) that extends from the bottom wall 32 and locks to the package along the bottom panel 26, rather than at the juncture of the package bottom and side panels 18, 26. A lateral stop element 52 configured as a holding tab can be formed extending upwardly from about the bottom wall 32, generally aligned with the sleeve side wall 30. The lock 48 and stop element 52 secure the package 14 laterally in the sleeve 10.

In the current C-shaped sleeve 10, the top wall 34 is short, extending less than the full length l of the top panel 24. It has been found that this configuration permits readily inserting a package 14 into the sleeve 10 while still providing the necessary stability and properly securing the package 14 in the sleeve 10. It has also been observed that this configuration provides sufficient strength such that the sleeve 10 and package 14 retain their shape when depressing the dispenser 12.

As best seen in FIGS. 1–2, the sleeve 10 can include flange or support walls 54, 56 that extend inwardly of the "C" from the bottom 32, side 30 and top 34 walls, generally perpendicular to the walls and parallel to the package side panels 20, 22. An open area 58 is defined by the edges of the support walls 54, 56. The support walls 54, 56 provide a gusseting function, thus strengthening the sleeve 10 to further resist deformation resulting from a downward force on the top wall 34, as by depressing the dispenser 12. The support walls 54, 56 can be formed on both "sides" of the sleeve 10, or alternate on only a single "side" of the sleeve 10 (e.g., formation of both walls 54 and 56, or alternately only one wall 54 or 56).

As is readily apparent from the figures, the sleeve 10 has an open configuration, as exemplified by the open area 58. That is, the sleeve 10 forms a spine or skeleton that defines the substantially large open area 58. To this end, the side wall 30 can be configured as a lattice having openings 60 therein, as well as the open areas 58 defined by the support walls 54, 56. This provides area for package 14 labeling and graphics to show through these opening areas 58, 60 to enhance product marketing. For example, the package 14 can be printed having specific graphics or indicia that show through the open areas 60 of the side wall 30, as well as inside of the support walls 54, 56 in open areas 58. Optionally, the sleeve side 30 wall can be configured having small or no open areas (e.g., a solid surface), and specific graphics or indicia can be formed, such as by molding, onto the side wall 30.

Figure 4:
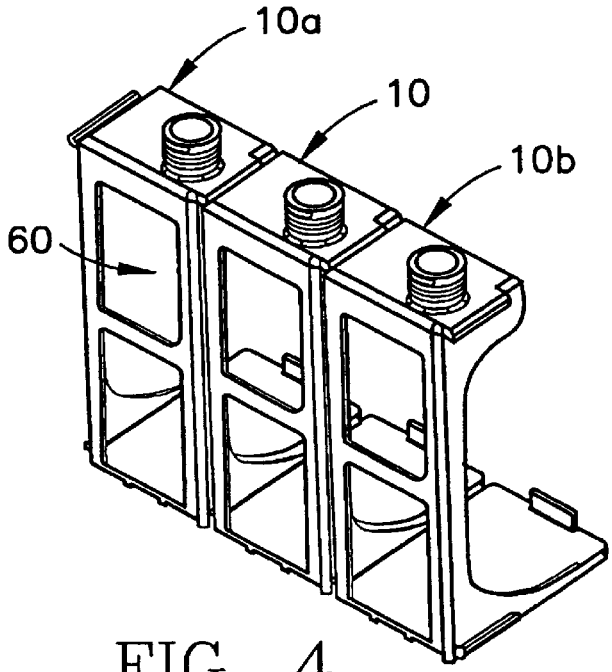
FIG. 4 illustrates three sleeves connected to one another, as may be used at a food service establishment.

As still another optional feature, the sleeve 10 can have locking elements formed thereon to permit securing the sleeve 10 to an adjacent, like sleeve 10*a*, 10*b*. As seen in FIG. 4, in the embodiment the locking elements are formed as hooks 62 and channels 64 in the side walls 30, bottom wall 32 and/or top wall 34. The hooks 62 and channels 64 permit locking the sleeves 10, 10*a*, 10*b* to one another (as seen in FIG. 4) in a side-by-side arrangement. In this manner, sleeves 10, 10*a*, 10*b* with product packages therein can be stored next to one another in a side-by-side arrangement in a food service establishment to, for example, maintain condiments, such as mustard, ketchup and mayonnaise next to one another at a service area.

Figure 5:
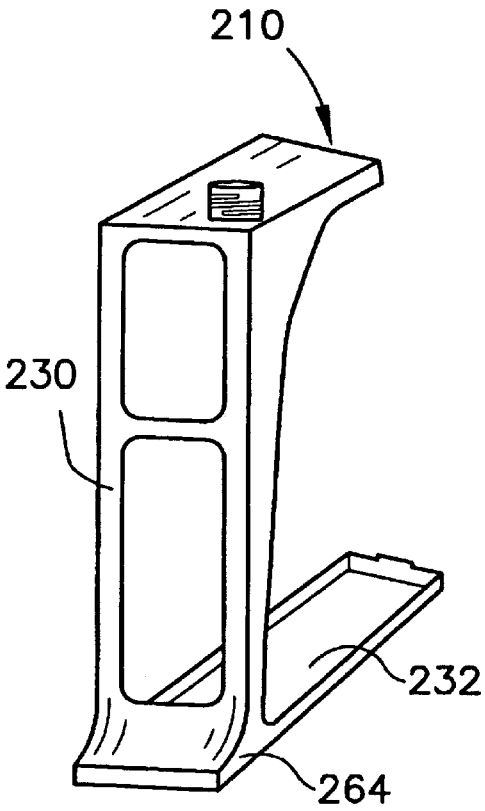
FIG. 5 is a perspective illustration of an alternate embodiment of the sleeve showing a supporting foot.
Figure 6:
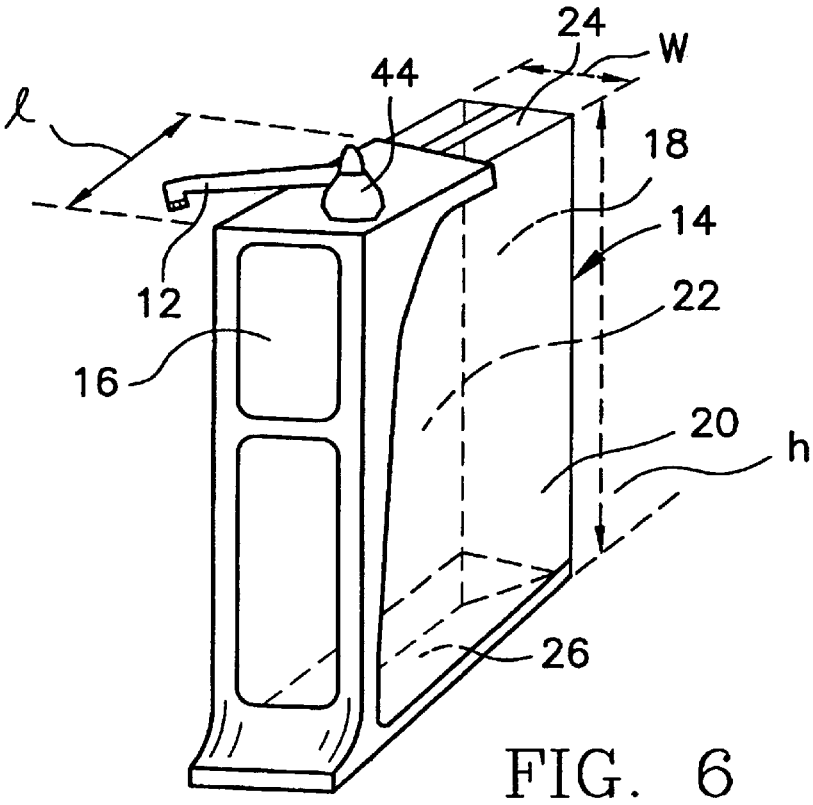
FIG. 6 is a perspective illustration of the sleeve of FIG. 5 with a package positioned in the sleeve and a dispenser fitted to the sleeve.

As still another optional feature, as illustrated in FIGS. 5 and 6, the sleeve 210 can include a sloped foot 264 that extends from the bottom wall 232, forwardly of the side wall 230. It has been found that this foot 264 increases the stability of the sleeve 210 and prevents tipping in the event that the dispenser 12 is overly aggressively pumped.

As provided above, in the alternate embodiment of the sleeve 110 illustrated in FIG. 8, the opening 138 in the top wall 134 is flush with the wall 134, rather than formed as a spout. In this manner, a package 114 having a projecting spout 140 affixed to the package 114 can be inserted into the sleeve 110 such that the spout 140 extends upward, out of the opening 138. The dispenser 12 can then be secured to the spout 140, to secure the package 114 in the sleeve 110 by the dispenser 12. Those skilled in the art will recognize that all of the illustrated embodiments of the sleeve 10, 110, 210 can have either the flush opening 138 or the projecting spout opening 38, or another type of dispenser receiving fitting, all of which are within the scope and spirit of the present invention.

Figure 10:
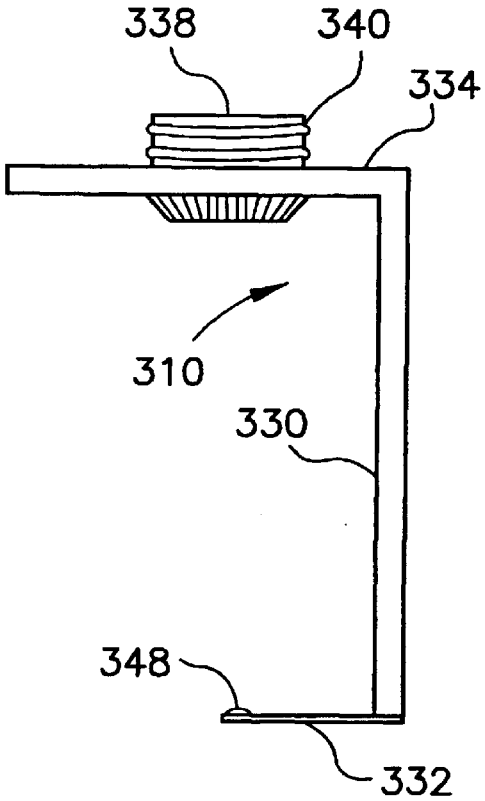
FIG. 10 is a side view of still another alternate embodiment of the sleeve.

Still another embodiment of the sleeve 310 is illustrated in FIG. 10. In this embodiment, the sleeve 310 includes a top wall 334, a side wall 330 and a bottom wall 332. Again, a package 14 fits snugly within the "C" of the sleeve 330. The side wall 330 extends the full height h of the package 14 from the bottom wall 332 to the top wall 334.

The top wall 334 is a full or substantially full wall. That is, the top wall 334 extends across the entire length l or substantially the entire length l of the package 14. The bottom wall 332 extends only along a portion of the length l of the package 14, and as such is a partial wall. The bottom wall 332 can include a lock portion 348 to secure the sleeve 310 to the bottom wall 26 of the package 14. Those skilled in the art will recognize that packages 14 from some packaging manufacturers (including those available from Tetra Brik Packaging Systems S.p.A. of Modena, Italy), are formed having bottom panels 26 that include angled panel portions (not shown). The lock 348 can be configured to secure to such an angled side panel, or other formation in the package. Alternately, of course, the sleeve 310 can be configured without any type of package lock.

The top wall 334 includes an opening 338 that is configured for receipt of the dispenser 12. The opening 338 can be a simple opening in the top wall 334, or it can be an upstanding spout 340, such as those illustrated in the sleeve 10 embodiment of, for example, FIG. 1.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dispensing support for an associated package, the package having a parallelepiped shape having a top panel having a length, a bottom panel having a length equal to the top panel length and two pairs of opposing side panels having a height, each panel being contiguous with each of its adjacent panels, the dispensing support comprising:

a sleeve having at least two adjacent side walls, a top wall, and a bottom wall, one of the side walls configured to extend along the length of the one of the package side panels, the top wall having an opening therein configured to lie along the package top, the sleeve including a locking element extending from one of the walls at a free end thereof configured to engage one of the package panels to secure the package within the sleeve; and a dispenser extending through the top wall opening and configured for insertion into the package, wherein the package is fitted into and retained within the sleeve and the dispenser operates to dispense a product from the package, wherein the at least two adjacent side walls define at least one corner extending fully between the top wall and the bottom wall.

2. The dispensing support in accordance with claim 1 wherein the top wall extends fully along the length of the package top panel.

3. The dispensing support in accordance with claim 1 wherein the top wall extends a length less than a length of the bottom wall.

4. The dispensing support in accordance with claim 1 including an upwardly projecting spout extending about the top wall opening.

5. The dispensing support in accordance with claim 4 wherein the spout includes threads formed thereon.

6. The dispensing support in accordance with claim 1 wherein one of the side walls includes openings therein.

7. The dispensing support in accordance with claim 6 wherein the openings are formed as a lattice-like configuration.

8. The dispensing support in accordance with claim 1 wherein the opening is formed in the top wall and is configured to receive a spout from an associated package.

9. The dispensing support in accordance with claim 1 wherein the locking element is formed on the bottom wall.

10. The dispensing support in accordance with claim 9 wherein the locking element is formed at an end of the bottom wall.

11. The dispensing support in accordance with claim 1 including a lateral stop element formed at the bottom wall.

12. The dispensing support in accordance with claim 1 including a latching element for securing the sleeve to a like, adjacent sleeve.

13. The dispensing support in accordance with claim 1 wherein the dispenser is a pump dispenser.

14. The dispensing support in accordance with claim 1 including a supporting foot extending from a juncture of the bottom wall and one of the side walls in a direction opposite the bottom wall relative to the side wall.

15. A dispensing support for an associated brick package, the brick package having a top panel having a length, a bottom panel having a length equal to the top panel length and two pairs of opposing side panels having a height, each panel being contiguous with each of its adjacent panels, the dispensing support comprising:

a sleeve having a top wall, a at least two adjacent side walls and a bottom wall, one of the side walls configured to extend along the length of the one of the package side panels, the bottom wall configured to extend along the length of the bottom panel and the top wall configured to extend along at least a part of the length of the top panel, the top wall having an opening therein configured to lie along the package top, the sleeve including a locking element extending from the bottom wall for engaging the package to secure the package within the sleeve; and a dispenser extending through the top wall opening and configured for insertion into the package, wherein the package is fitted into and retained within the sleeve and the dispenser operates to dispense a product from the package, wherein the at least two adjacent side walls define at least one corner extending fully between the top wall and the bottom wall.

16. The dispensing support in accordance with claim 15 wherein the top wall extends fully along the length of the package top panel.

17. The dispensing support in accordance with claim 15 wherein the top wall extends a length less than a length of the bottom wall.

18. The dispensing support in accordance with claim 15 including an upwardly projecting spout extending about the top wall opening.

19. The dispensing support in accordance with claim 15 wherein the locking element is formed at an end of the bottom wall.

20. The dispensing support in accordance with claim 15 including a supporting foot extending from a juncture of the bottom wall and one of the side walls in a direction opposite the bottom wall relative to the side wall.

* * * * *